US008403602B2

(12) United States Patent
Zarnescu

(10) Patent No.: US 8,403,602 B2
(45) Date of Patent: Mar. 26, 2013

(54) COAL FLOW SPLITTERS AND DISTRIBUTOR DEVICES

(75) Inventor: Vlad Zarnescu, Worcester, MA (US)

(73) Assignee: Babcock Power Services, Inc., Worcester, MA (US)

( * ) Notice: Subject to any disclaimer, the term of this patent is extended or adjusted under 35 U.S.C. 154(b) by 0 days.

(21) Appl. No.: 13/048,921

(22) Filed: Mar. 16, 2011

(65) Prior Publication Data

US 2012/0237304 A1 Sep. 20, 2012

(51) Int. Cl.
*B65G 51/18* (2006.01)

(52) U.S. Cl. ..... 406/181; 406/86; 209/143; 110/310; 110/101 R

(58) Field of Classification Search ..... 406/181, 406/86; 110/310, 311, 312, 101 R; 209/143, 209/717, 718
See application file for complete search history.

(56) References Cited

U.S. PATENT DOCUMENTS

| | | | | | |
|---|---|---|---|---|---|
| 1,871,853 | A | * | 8/1932 | Kennedy | 406/181 |
| 2,975,001 | A | | 3/1961 | Davis | |
| 3,265,442 | A | * | 8/1966 | Willis, Jr. et al. | 406/181 |
| 4,094,492 | A | | 6/1978 | Beeman et al. | |
| 4,191,500 | A | * | 3/1980 | Oberg et al. | 406/146 |
| 4,356,975 | A | | 11/1982 | Chadshay | |
| 4,412,496 | A | | 11/1983 | Trozzi | |
| 4,459,922 | A | | 7/1984 | Chadshay | |
| 4,478,157 | A | | 10/1984 | Musto | |
| 4,562,968 | A | * | 1/1986 | Widmer et al. | 239/655 |
| 4,570,549 | A | | 2/1986 | Trozzi | |
| 4,634,054 | A | | 1/1987 | Grusha | |
| 4,779,546 | A | | 10/1988 | Walsh, Jr. | |
| 4,790,692 | A | * | 12/1988 | Bunyoz et al. | 406/181 |
| 5,215,259 | A | | 6/1993 | Wark | |
| 5,593,131 | A | | 1/1997 | Briggs, Jr. et al. | |
| 5,623,884 | A | | 4/1997 | Penterson et al. | |
| 5,685,240 | A | | 11/1997 | Briggs, Jr. et al. | |
| 5,788,727 | A | * | 8/1998 | Barthelmess | 55/406 |
| 5,934,205 | A | | 8/1999 | Gordon et al. | |
| 5,975,141 | A | | 11/1999 | Higazy | |
| 5,979,343 | A | * | 11/1999 | Gregor et al. | 111/175 |
| 6,055,914 | A | | 5/2000 | Wark | |
| 6,290,433 | B2 | * | 9/2001 | Poncelet et al. | 406/181 |
| 6,494,151 | B1 | * | 12/2002 | Wark | 110/129 |
| 6,588,598 | B2 | | 7/2003 | Wark | |
| 6,789,488 | B2 | | 9/2004 | Levy et al. | |
| 6,811,358 | B2 | | 11/2004 | Bauver et al. | |
| 6,899,041 | B2 | * | 5/2005 | Wark | 110/106 |
| 7,013,815 | B2 | | 3/2006 | Levy et al. | |
| 7,017,501 | B2 | | 3/2006 | Mann | |
| 7,785,043 | B2 | * | 8/2010 | Elsen | 406/12 |
| 8,082,860 | B2 | * | 12/2011 | Courtemanche et al. | 110/263 |
| 2010/0154689 | A1 | | 6/2010 | Adam et al. | |
| 2012/0186501 | A1 | * | 7/2012 | Zarnescu et al. | 110/101 R |

* cited by examiner

*Primary Examiner* — Joseph A Dillon, Jr.
(74) *Attorney, Agent, or Firm* — Edwards Wildman Palmer LLP; Joshua L. Jones

(57) ABSTRACT

A flow splitter for distributing solid particles flowing in a fluid through a piping system includes a divider housing. The divider housing has an inlet configured to connect to an upstream pipe and has a plurality of outlets, each outlet being configured to connect to a respective downstream pipe. A divider body is mounted within the divider housing. A plurality of divider vanes are included, each extending from the divider body to the divider housing. The divider housing, divider body, and divider vanes are configured and adapted to reduce non-uniformity in particle concentration from the inlet and to supply a substantially equal particle flow to each outlet.

16 Claims, 5 Drawing Sheets

COAL FLOW SPLITTERS AND DISTRIBUTOR DEVICES

BACKGROUND OF THE INVENTION

1. Field of the Invention

The present invention relates to distribution of solid particles flowing in a fluid, and more particularly to coal particle distribution in airflow through coal piping systems.

2. Description of Related Art

A variety of devices and methods are known in the art for delivering pulverized coal to coal fired burners. Of such devices, many are directed to improving particle distribution within coal piping systems for delivering coal to be combusted.

Coal powered plants require an efficient means of supplying coal as fuel to produce heat power. Raw coal is typically pulverized in a coal pulverizer or mill to produce small coal particles or coal dust. The pulverized coal must then be delivered to a furnace or burner where it can be used for combustion. This is typically done with a coal piping system that utilizes air flows to transport pulverized coal particles from the mill or pulverizer to a nozzle where coal particles are injected into the coal burner or furnace. As the coal particles travel in the air flow through the piping system, bends in the piping and the pipe geometry in general tend to cause non-uniform coal particle distribution. A densely packed region of coal particles extending through a piping system is referred to as a coal "rope."

Coal roping causes various technical problems for operation and maintenance of coal systems. The poor distribution of coal particles can extend into the combustion zone, where localized imbalances in the fuel/air mixture tend to cause inefficient combustion and elevated emissions of $NO_x$, CO, and other pollutants. It can also cause elevated levels of unburned carbon in the fly ash, which will lower combustion efficiency. Also, the highly abrasive nature of the coal rope impacting and scrubbing components of the coal piping and burning system causes extensive erosion of pipes and other components in the system, leading to frequent need for inspection, repairs, and replacement of parts. If inspections, repairs and replacements are not performed in a timely manner, there is an elevated chance that abrasion from coal roping will cause expensive or dangerous failures of key components.

One component that is particularly problematic for coal roping is the dividing head at the junction between a single pipe upstream of two or more branching pipes downstream, as is commonly seen upstream of directional flame burner coal nozzles, for example. In such a dividing head, if a flow with a coal rope enters the dividing head, one of the downstream legs will tend to receive the coal rope portion of the flow, meaning that one of the downstream nozzles will receive significantly more coal than the other nozzle or nozzles connected to the same dividing head.

Such conventional methods and systems have generally been considered satisfactory for their intended purpose. However, there is still a need in the art for systems and methods that allow for improved particle distribution downstream of dividing heads, for example. There also remains a need in the art for such systems and methods that are easy to make and use. The present invention provides solutions for these problems.

SUMMARY OF THE INVENTION

The subject invention is directed to a new and useful flow splitter for distributing solid particles flowing in a fluid through a piping system. For example, the flow splitter can be a coal flow splitter for distributing coal fines flowing in an air flow through a coal piping system. The flow splitter includes a divider housing having an inlet configured to connect to an upstream pipe and having a plurality of outlets, each outlet being configured to connect to a respective downstream pipe. A divider body is mounted within the divider housing. A plurality of divider vanes are included, each extending from the divider body to the divider housing. The divider housing, divider body, and divider vanes are configured and adapted to reduce non-uniformity in particle concentration from the inlet and to supply a substantially equal particle flow to each outlet.

In accordance with certain embodiments, the divider body is conical and is mounted concentric within the divider housing. The divider body can diverge in a direction from the inlet of the divider housing to the outlets thereof, and can extend substantially from the inlet of the divider housing to the outlets thereof. It is contemplated that the inlet can be castellated with peripherally spaced teeth that extend inward. The inlet and outlets can each be circular, or any other suitable shape.

In certain embodiments, the plurality of divider vanes includes four divider vanes spaced apart circumferentially around a longitudinal axis running from the inlet to the outlets of the divider body. The circumferential spacing of the divider vanes can be even, at 90° intervals. The divider vanes can extend substantially from the inlet to the outlets, and can each be aligned parallel to the longitudinal axis.

It is contemplated that the divider housing can include an outlet plate opposed to the inlet of the divider housing and substantially perpendicular to a longitudinal axis running from the inlet to the outlets of the divider body. The outlets of the divider head can be four circular outlets defined through the outlet plate. Each divider vane can be evenly spaced between a respective pair of the four circular outlets. The outlet plate can have a rectangular periphery, with one of the divider vanes mounted at a mid-point of each side thereof. It is also contemplated that each corner joining respective sides of the rectangular periphery of the outlet plate can be rounded, and can be substantially concentric with a respective one of the outlets.

In accordance with certain aspects, the inlet defines an inlet area, the outlets define an outlet area, and the ratio of the inlet area to the outlet area can be about 1.0. The divider housing, divider body, and divider vanes can be configured and adapted to have a pressure drop that is less than about 3.2 in $H_2O$ from the inlet to the outlets.

These and other features of the systems and methods of the subject invention will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein.

DETAILED DESCRIPTION OF THE PREFERRED EMBODIMENTS

Figure 1:
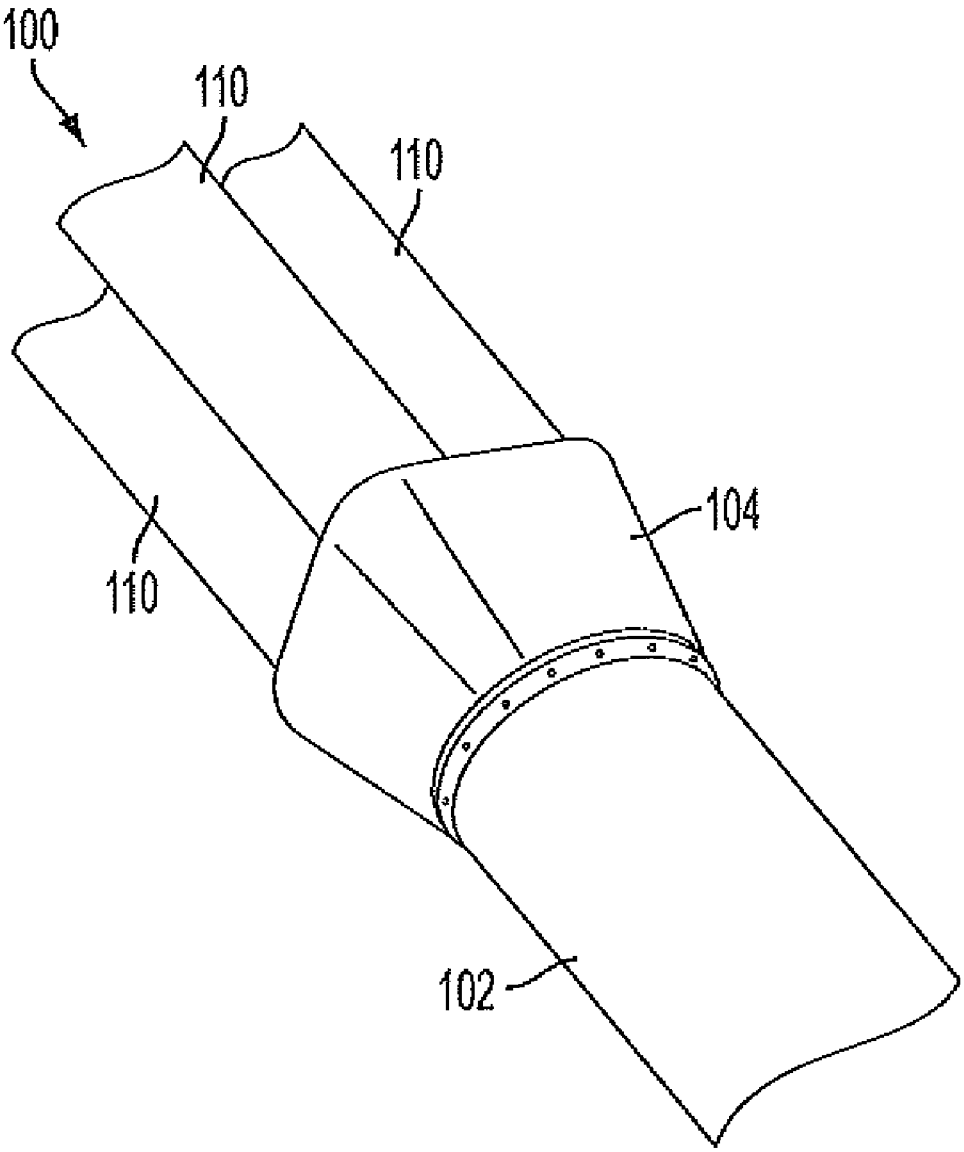
FIG. 1 is a perspective view of a portion of an exemplary embodiment of a coal piping system constructed in accordance with the present invention, showing the flow splitter device for dividing flow from a single upstream coal pipe to four downstream coal pipes.

Reference will now be made to the drawings wherein like reference numerals identify similar structural features or aspects of the subject invention. For purposes of explanation and illustration, and not limitation, a partial view of an exemplary embodiment of a coal piping system in accordance with the invention is shown in FIG. 1 and is designated generally by reference character 100. Other embodiments of coal piping systems in accordance with the invention, or aspects thereof, are provided in FIGS. 2-5, as will be described. The systems and methods of the invention can be used to improve particle distribution downstream of piping splits, for example in coal piping systems and the like.

Coal piping system 100 includes an upstream pipe 102 for conveying coal fines from an upstream source such as a pulverizer, in a flow of air to be burned in a downstream furnace or boiler. Flow splitter 104 connects to pipe 102 and includes internal components, which are described in detail below, for evenly distributing solid particles flowing in a fluid through system 100. The split in the flow from upstream pipe 102 is initiated by flow splitter 104, and the split is complete in downstream coal pipes 110. While only three pipes 110 are visible in the view of FIG. 1, there are a total of four pipes 110, which lead to four respective coal nozzles, for example, where the coal is injected for combustion.

Figure 2:
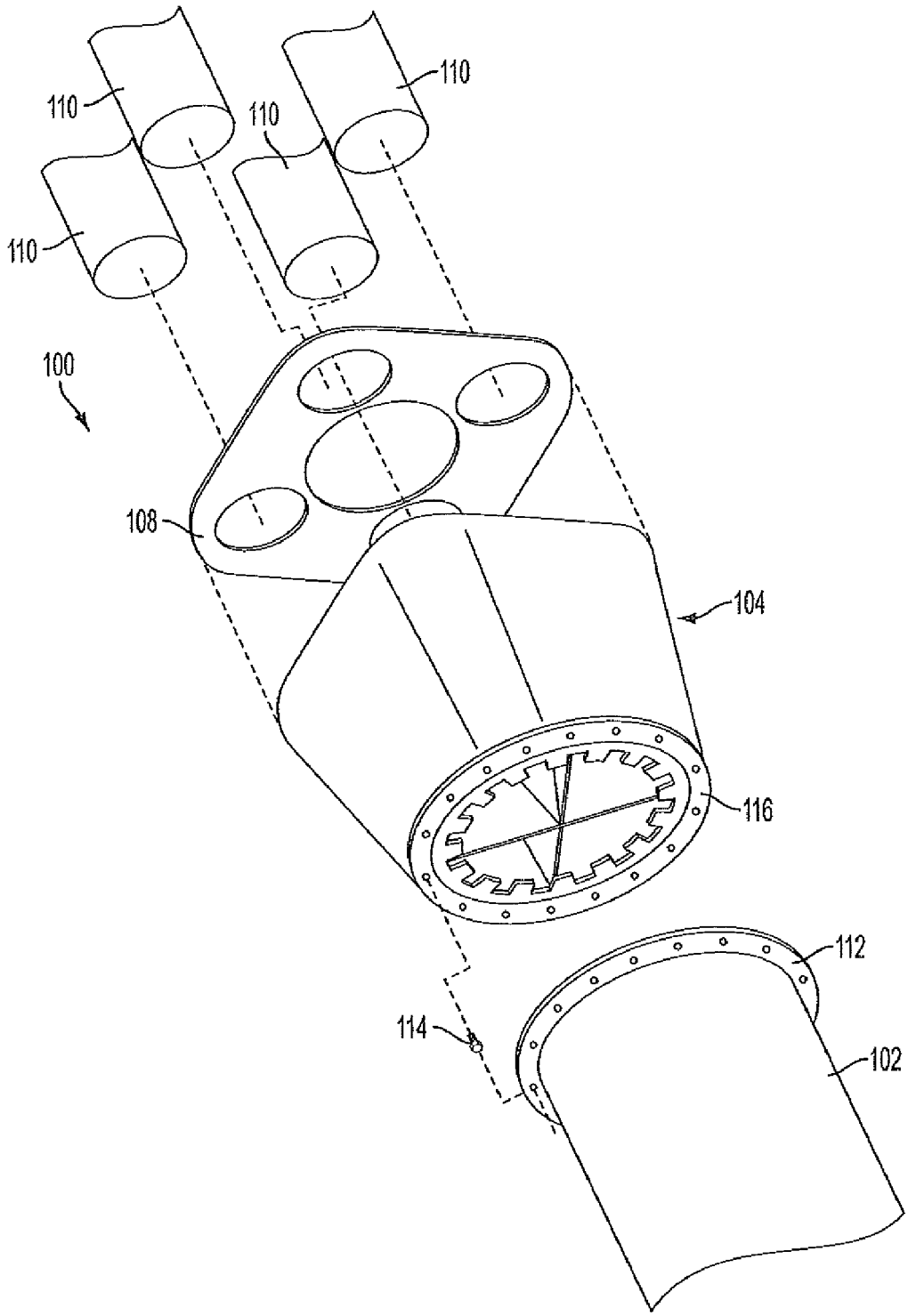
FIG. 2 is an exploded perspective view of a portion of the coal piping system of FIG. 1, showing an enlarged view of the flow splitter separated from the upstream and downstream pipes, with the outlet plate separated from the flow splitter.

Referring now to FIG. 2, flow splitter 104 is configured to be mounted between pipe 102 upstream and pipes 110 downstream. The circular flange 112 of pipe 102 can be bolted, e.g., buy bolts such as bolt 114, to circular flange 116 of flow splitter 104. The four pipes 110 are joined to flow splitter 104 by welding, or any other suitable joining technique. It is contemplated that flow splitter 104 can be mounted between an existing upstream coal pipe and four downstream pipes, for example by fitting between existing pipe flanges, as a retrofit with little or no modification needed to the existing system. It is also contemplated that flow splitters such as flow splitter 104 can be mounted in newly constructed coal piping systems.

Figure 3:
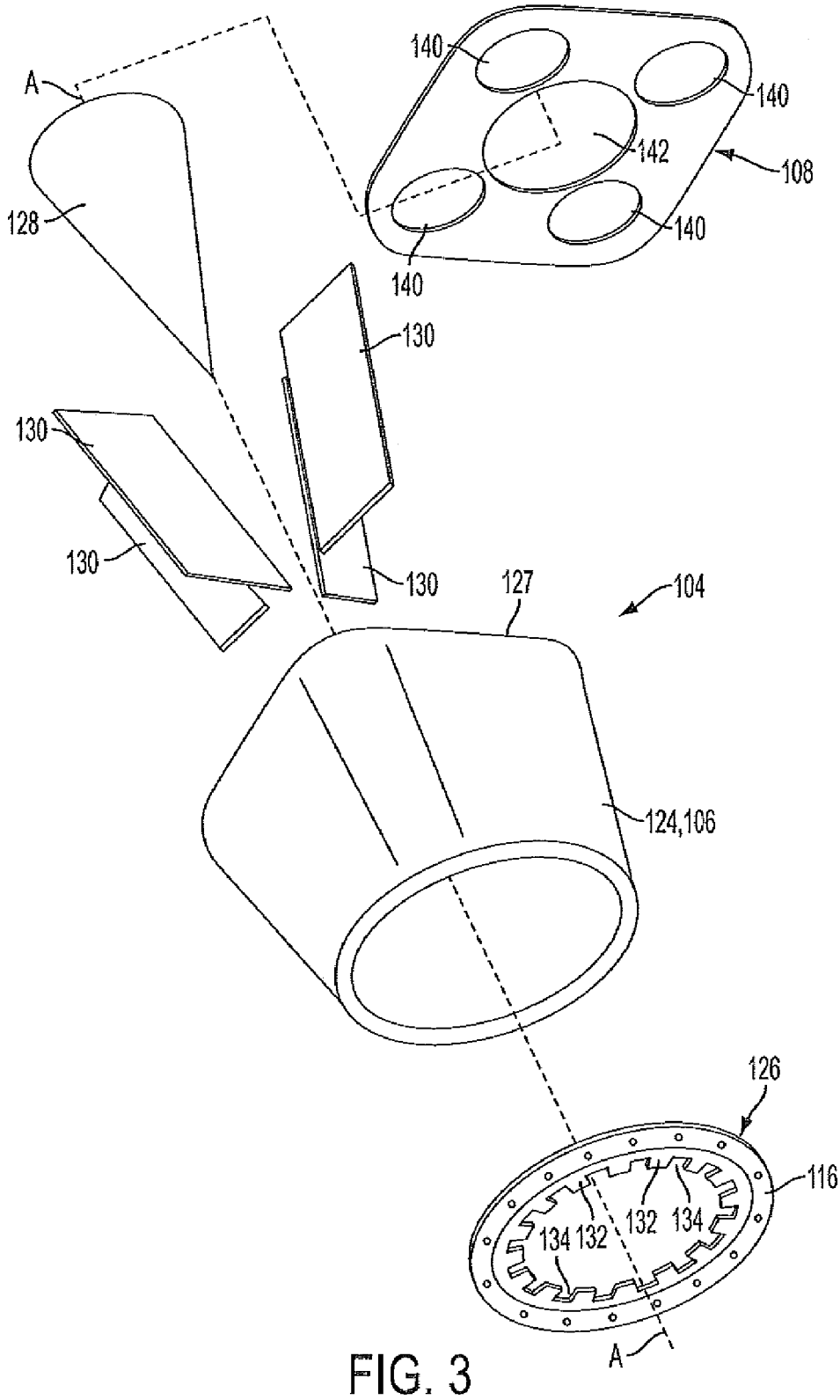
FIG. 3 is an exploded perspective view of a the flow splitter of FIG. 2, showing the divider body, divider vanes, and the teeth of the castellated inlet.

With reference now to FIG. 3, the internal components of flow splitter 104 are contained within a divider housing 124, which includes a circular inlet 126 mounted to upstream coal pipe 102 by flange 116 as described above. Inlet 126 is castellated with peripherally spaced teeth 132 that extend radially inward between peripherally spaced gaps 134 (in FIG. 3, only some of the teeth 132 and gaps 134 are labeled with reference characters for sake of clarity). There are a total of sixteen teeth 132 and sixteen gaps 134, however, those skilled in the art will readily appreciate that any suitable number of teeth/gaps can be used from application to application without departing from the spirit and scope of the invention. The outlet end 127 of divider housing 124 is generally rectangular. Divider housing 124 includes an outlet plate 108 that is mounted opposite inlet 126, perpendicular to longitudinal axis A, when assembled. Outlet plate 108 is generally rectangular, and the corners of the peripheries of outlet plate 108 and outlet end 127 have rounded corners.

The exterior and interior surfaces of divider housing 124 generally define a shape that is a constant blend from a circular cross-section at circular inlet 126 to a square cross-section at rectangular outlet 127. While rectangular outlet 127 of divider housing 124 is shown and described as being square, those skilled in the art will readily appreciate that a rectangle of any other suitable proportions, or any other suitable shape in general, can be used for the outlet without departing from the spirit and scope of the invention.

Referring still to FIG. 3, outlet plate 108 includes five circular apertures defined therethrough, including four outlet apertures 140 where the four downstream pipes 110 can be joined to flow splitter 104. The remaining aperture is central aperture 142, which is joined to the hollow outlet end of divider body 128 when assembled, so the center of flow splitter 104 is an open, hollow cone. Each of the rounded corners of outlet plate 108 is concentric with the respective adjacent outlet aperture 140.

A divider body 128 is mounted in concentric, axial alignment within divider housing 124, and extends from the inlet end of divider housing 124 to outlet end 127 thereof. Divider body 128 is conical and diverges in a direction from the inlet end of divider housing 124 toward outlet end 127 thereof.

Referring still to FIG. 3, four divider vanes 130 are included within divider housing 124, each extending radially from divider body 128 in the center to the lengthwise outer wall 106 of divider housing 124. Divider housing 124, divider body 128, and divider vanes 130 are welded together, but could also be joined using any other suitable technique without departing from the spirit and scope of the invention.

Figure 4:
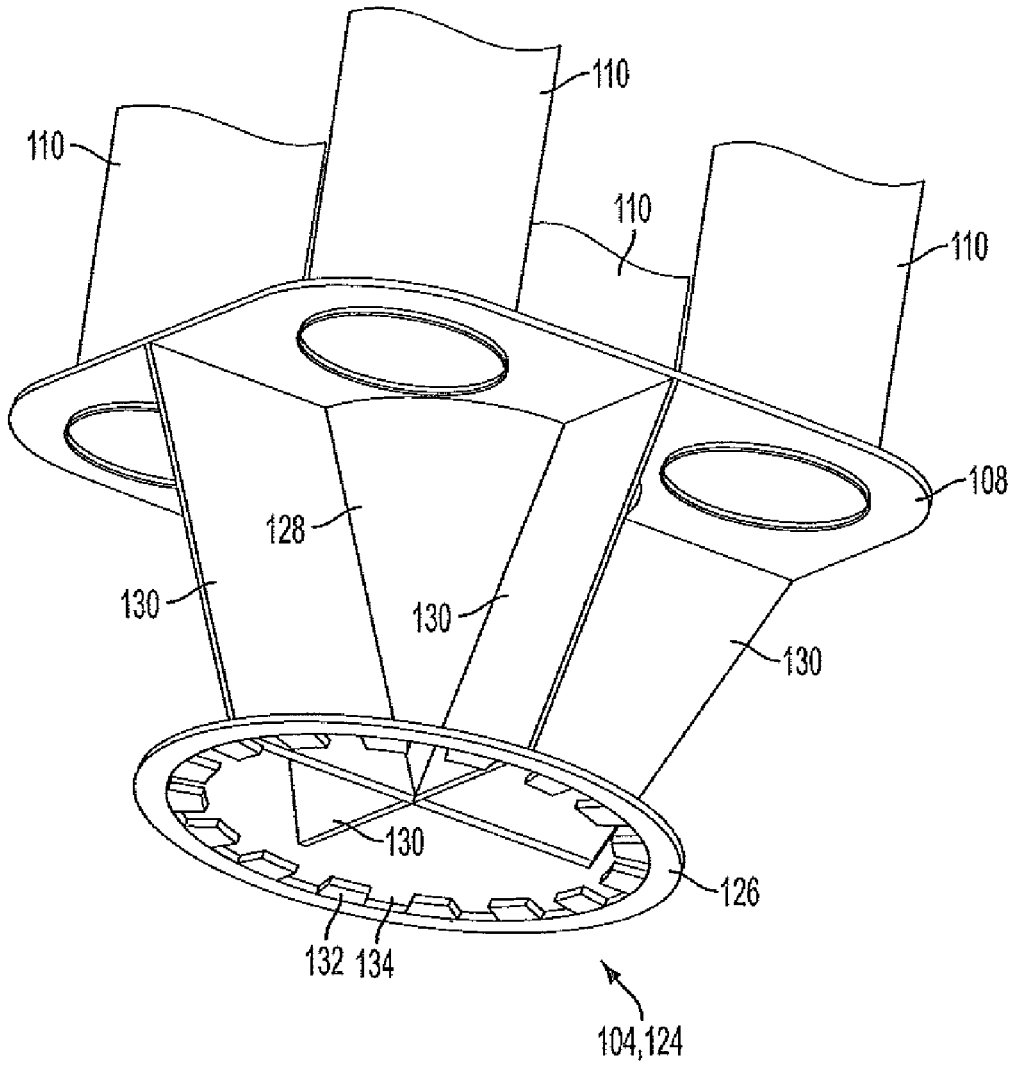
FIG. 4 is a cut-away perspective view of a portion of the flow splitter of FIG. 2, showing the divider body, divider vanes, and outlet plate assembled together.
Figure 5:
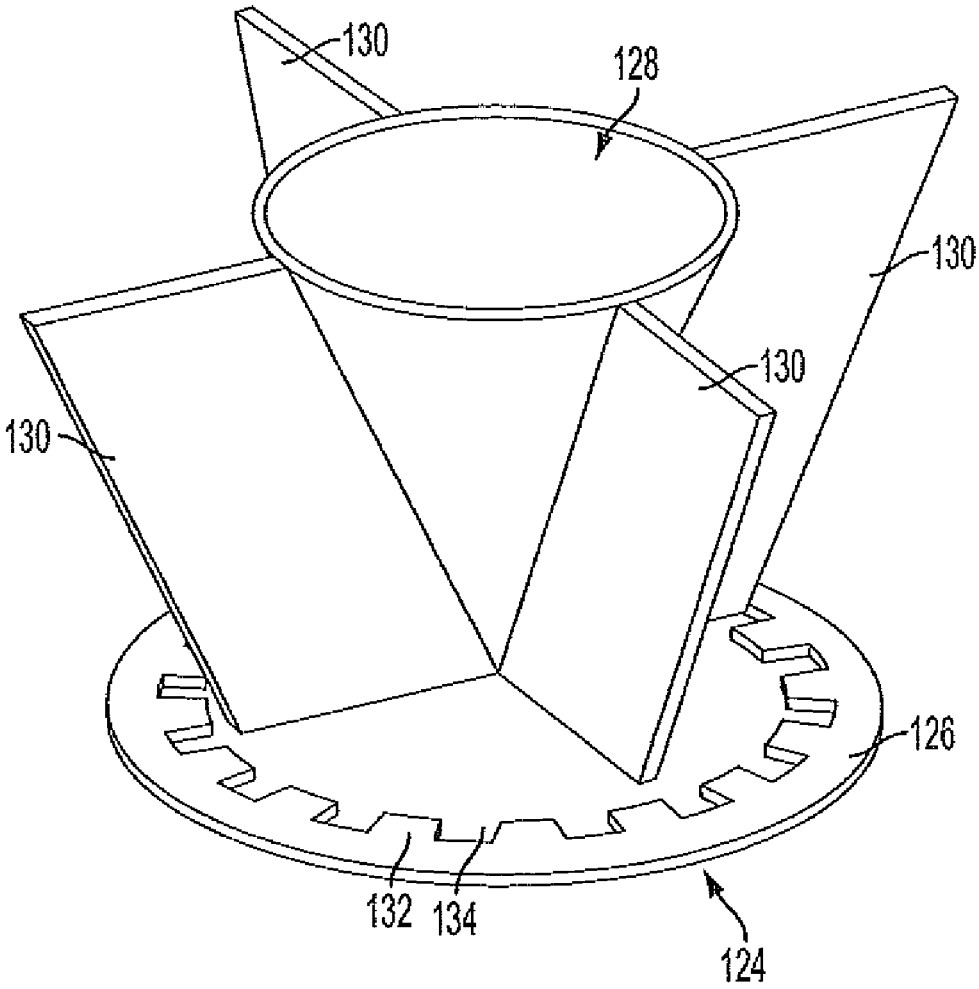
FIG. 5 is a cut-away perspective view of a portion of the flow splitter of FIG. 4, showing the castellated inlet, divider body, and divider vanes with the outer wall and outlet plate of the divider housing removed.

FIG. 4 shows flow splitter 104 with outer wall 106 removed to show the arrangement of divider body 128 and divider vanes 130. The four divider vanes 130 are spaced apart circumferentially around a longitudinal axis of divider body 128 at 90° intervals. In the axial direction, the four divider vanes 130 extend from the inlet end to the outlet end of divider housing 124, and end proximate the outlet end of divider body 128. As shown in FIG. 5, the outlet end of divider body 128 is hollow, with the downstream end thereof being open and joined to central aperture 142 when assembled, as described above.

Divider vanes 130 are each aligned parallel to the longitudinal axis (labeled A in FIG. 3) running from the inlet end to the outlet end of divider body 128. The four divider vanes 130 are each aligned with a center of an edge of the rectangular outlet end 127 and outlet plate 108 of divider housing 124. The radially inner and outer edges of each divider vane 130 conform to the adjacent surface of divider body 128 and outer wall 106, respectively. The alignment of the divider vanes 128 and the teeth 132 and gaps 134 of inlet 126 shown in FIGS. 2 and 4-5 is exemplary, as it is contemplated that any suitable alignment of these elements can be used without departing from the spirit and scope of the invention.

Flow splitter 104 is a generally two-part construction, namely, the ring of toothed inlet 126, and the four-way distributor in the main portion of flow splitter 104 that includes four divider vanes 130. The overall shape and flow area of flow splitter 104 described above are configured to reduce or minimize the impact on pressure drop in coal piping systems utilizing flow splitter 104. It is contemplated that the pressure drop through flow splitter 104 can be less than about 3.2 in $H_2O$. A good way to quantify the pressure drop in this type of system is to measure pressure in planes located 3-5 diameters upstream and downstream of the device. It is also contemplated that while the flow area defined through flow splitter 104 need not necessarily be constant along a flow path from the inlet to the outlets, preferably the ratio of the inlet area to the outlet area (of all the inlets added together) is close to 1.0.

Divider housing 124, divider body 128, and divider vanes 130 are configured and adapted to reduce non-uniformity in particle concentration from the inlet and to supply a substantially equal particle flow from outlet end 127 to each of the downstream pipes 110. In particular, flow splitter 104 is configured to break the coal rope and redistribute the coal particles between four downstream pipes, such as those in the directional flame burner coal nozzles described in U.S. Pat. No. 5,623,884, which is incorporated by reference herein in its entirety.

Flow splitter 104 creates a more uniform coal distribution in a flow of coal passing therethrough, which results in improved controllable combustion performance. Flow splitter 104 is also configured and adapted to balance the flow of coal at the division point between the upstream coal pipe, e.g., pipe 102, and the four downstream pipes, e.g., pipes 110. In other words, flow splitter 104 improves particle distribution by both breaking up any coal rope to provide substantially equal amounts of coal to each downstream pipe 110, and also by distributing coal particles substantially uniformly within each downstream pipe 110. This is accomplished by the combination of the toothed ring of inlet 126 breaking any coal rope and by the flow splitter of vanes 130 further distributing and balancing the distribution of particles into the four downstream pipes 110. This is particularly advantageous when the four downstream pipes 110 are part of directional flame burner coal nozzles.

Since flow splitter 104 balances the flow in piping system 100, the more even distribution of coal particles and air in each downstream pipe 110 produces a more uniform, balanced flow to the burners, nozzles, or the like, downstream thereof. The specific shape of flow splitter 104 creates regions of cross mixing using a combination of sloped (e.g., the surface of divider body 128), segmented (e.g., the toothed portion of inlet 126), and solid (e.g. the surfaces of vanes 130) areas around the circumference of the device. Precise placement of flow splitter 104 is based on coal pipe orientation and is important for optimum fuel balancing. The placement shown and described herein is exemplary, and those skilled in the art will readily appreciate that any other suitable positioning can be used for a given application without departing from the spirit and scope of the invention.

While described above in the exemplary context of four downstream pipes 110, those skilled in the art will readily appreciate that any suitable number of downstream pipes can be used without departing from the spirit and scope of the invention. For example, an equilateral triangular configuration can be used in lieu of a square configuration for applications where there are only three downstream pipes. Moreover, while described herein in the exemplary context of coal piping systems, those skilled in the art will readily appreciate that the methods and devices described herein can be used with any other suitable type of flow with particles flowing in a fluid without departing from the spirit and scope of the invention.

The methods and systems of the present invention, as described above and shown in the drawings, provide systems for particle distribution with superior properties including more uniform flow downstream of divider heads. While the apparatus and methods of the subject invention have been shown and described with reference to preferred embodiments, those skilled in the art will readily appreciate that changes and/or modifications may be made thereto without departing from the spirit and scope of the subject invention.

What is claimed is:

1. A flow splitter for distributing solid particles flowing in a fluid through a piping system, the flow splitter comprising:

a) a divider housing having an inlet configured to connect to an upstream pipe, wherein the inlet is castellated with peripherally spaced teeth that extend inward, and having a plurality of outlets, each outlet being configured to connect to a respective downstream pipe;

b) a divider body mounted within the divider housing; and c) a plurality of divider vanes, each extending from the divider body to the divider housing, wherein the divider housing, divider body, and divider vanes are configured and adapted to reduce non-uniformity in particle concentration from the inlet and to supply a substantially equal particle flow to each outlet.

2. A flow splitter as recited in claim 1, wherein the divider body is conical and is mounted concentric within the divider housing.

3. A flow splitter as recited in claim 2, wherein the divider body diverges in a direction from the inlet of the divider housing to the outlets thereof.

4. A flow splitter as recited in claim 3, wherein the divider body extends substantially from the inlet of the divider housing to the outlets thereof.

5. A flow splitter as recited in claim 1, wherein the inlet and outlets are each circular.

6. A flow splitter as recited in claim 1, wherein the plurality of divider vanes includes four divider vanes spaced apart circumferentially around a longitudinal axis of the divider body at 90° intervals.

7. A flow splitter as recited in claim 1, wherein the divider vanes extend substantially from the inlet to the outlets.

8. A flow splitter as recited in claim 1, wherein the divider vanes are each aligned parallel to a longitudinal axis running from the inlet to the outlets.

9. A flow splitter as recited in claim 1, wherein the divider housing includes an outlet plate opposed to the inlet of the divider housing and substantially perpendicular to a longitudinal axis running from the inlet to the outlets of the divider body, wherein the outlets of the divider head are four circular outlets defined through the outlet plate, wherein the plurality of divider vanes includes four divider vanes spaced apart circumferentially around the longitudinal axis with each divider vane evenly spaced between a respective pair of the four circular outlets.

10. A flow splitter as recited in claim 9, wherein the outlet plate has a rectangular periphery, with one of the divider vanes mounted at a mid-point of each side thereof.

11. A flow splitter as recited in claim 10, wherein each corner joining respective sides of the rectangular periphery of the outlet plate is rounded.

12. A flow splitter as recited in claim 11, wherein each rounded corner of the outlet plate is substantially concentric with a respective one of the outlets.

13. A flow splitter as recited in claim 1, wherein the inlet defines an inlet area, the outlets define an outlet area, and wherein the ratio of the inlet area to the outlet area is about 1.0.

14. A coal flow splitter for distributing coal fines flowing in an air flow through a coal piping system, the coal flow splitter comprising:

a) a divider housing having a circular inlet configured to connect to an upstream coal pipe, wherein the inlet is castellated with peripherally spaced teeth that extend inward, and having an outlet plate opposite the inlet with four circular outlets defined therethrough, each outlet being configured to connect to a respective downstream coal pipe;

b) a divider body mounted within the divider housing; and c) a plurality of divider vanes, each extending from the divider body to the divider housing, wherein the divider housing, divider body, and divider vanes are configured and adapted to reduce non-uniformity in coal particle concentration from the inlet and to supply a substantially equal coal particle flow to each outlet.

15. A coal flow splitter as recited in claim 14, wherein the divider body is conical and is mounted concentric within the divider housing, wherein the divider body extends substantially from the inlet of the divider housing to the outlet plate, and wherein the divider body diverges in a direction from the inlet of the divider housing to the outlets thereof.

16. A coal flow splitter as recited in claim 14, wherein the plurality of divider vanes includes four divider vanes spaced apart circumferentially around a longitudinal axis running from the inlet to the outlets with each divider vane evenly spaced between a respective pair of the four outlets, wherein the divider vanes extend substantially from the inlet to the outlets, wherein the divider vanes are each aligned parallel to the longitudinal axis, wherein the outlet plate has a rectangular periphery, with one of the divider vanes mounted at a mid-point of each side thereof, and wherein each corner joining respective sides of the rectangular periphery of the outlet plate is rounded and is substantially concentric with a respective one of the outlets.

* * * * *